US012805680B2

(12) United States Patent
Hillard

(10) Patent No.: US 12,805,680 B2
(45) Date of Patent: Nov. 24, 2026

(54) HOLLOW ARTICULATING STRUCTURE

(71) Applicant: Mullet Tools, LLC, Dripping Springs, TX (US)

(72) Inventor: Jacob Lee Hillard, Plainville, KS (US)

( * ) Notice: Subject to any disclaimer, the term of this patent is extended or adjusted under 35 U.S.C. 154(b) by 284 days.

(21) Appl. No.: 18/533,346

(22) Filed: Dec. 8, 2023

(65) Prior Publication Data

US 2024/0188779 A1 Jun. 13, 2024

Related U.S. Application Data

(60) Provisional application No. 63/488,601, filed on Mar. 6, 2023, provisional application No. 63/386,737, filed on Dec. 9, 2022.

(51) Int. Cl.

| | |
|---|---|
| ***A47L 9/24*** | (2006.01) |
| *A47L 5/12* | (2006.01) |
| *A47L 9/04* | (2006.01) |
| *A47L 9/16* | (2006.01) |

(52) U.S. Cl.

CPC ..... *A47L 9/248* (2013.01); *A47L 9/244* (2013.01); *A47L 5/12* (2013.01); *A47L 9/0455* (2013.01); *A47L 9/1683* (2013.01)

(58) Field of Classification Search

CPC . A47L 9/248; A47L 9/244; A47L 5/12; A47L 9/0455; A47L 9/1683; A47L 9/242; F16M 11/12

See application file for complete search history.

(56) References Cited

U.S. PATENT DOCUMENTS

| | | | | |
|---|---|---|---|---|
| 4,158,462 | A * | 6/1979 | Coral | H01R 35/02 285/283 |
| 4,540,202 | A * | 9/1985 | Amphoux | F16L 27/0857 403/111 |
| 5,336,130 | A * | 8/1994 | Ray | B08B 15/002 454/65 |
| 6,315,259 | B1 * | 11/2001 | Kolb | F16M 13/02 248/278.1 |
| 12,290,845 | B2 * | 5/2025 | Stenberg | F16L 27/0857 |
| 2007/0044268 | A1 * | 3/2007 | Cheng | A47L 9/248 15/314 |
| 2022/0061615 | A1 | 3/2022 | Hillard | |
| 2024/0188779 | A1 | 6/2024 | Hillard | |

FOREIGN PATENT DOCUMENTS

| | | | | |
|---|---|---|---|---|
| FR | 2892976 A1 * | 5/2007 | | B60H 1/00564 |
| WO | WO-9705421 A1 * | 2/1997 | | F16L 27/0837 |

OTHER PUBLICATIONS

Mar. 12, 2025—(CA) Office Action—App 3,222,455.

* cited by examiner

*Primary Examiner* — Eldon T Brockman
(74) *Attorney, Agent, or Firm* — Dale J. Ream

(57) ABSTRACT

A hollow articulating structure includes a plurality of pipes interconnected with a plurality of knuckle assemblies. The hollow articulating structure may be connected to a vacuum source to allow a user to move the articulating structure to position an end of the articulating structure in a desired location to move dust and particles through the hollow articulating structure to the vacuum source. Each knuckle assembly includes a first knuckle member and a second knuckle member that are rotationally movable with each other to allow the articulating structure to be adjusted and moved.

19 Claims, 14 Drawing Sheets

HOLLOW ARTICULATING STRUCTURE

CROSS-REFERENCE TO RELATED MATTERS

This application claims priority to and the benefit of U.S. Application No. 63/386,737 filed on Dec. 9, 2022 and also claims priority to and benefit of U.S. Application No. 63/488,601 filed on Mar. 6, 2023. The above referenced applications are incorporated by reference in their entirety.

TECHNICAL FIELD

This disclosure relates to a hollow articulating structure or arm for use with vacuum devices or other dust collection systems.

BACKGROUND

Dust collection during many manufacturing or other types of processes may help to provide a clean workspace. A portable and easily movable vacuum system can help improve the process of cleaning the workspace.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this disclosure may relate to a hollow articulating structure configured to connect to a vacuum source comprising: (a) a first hollow pipe connected to the vacuum source; (b) a second hollow pipe; and (c) a knuckle assembly comprising: (1) a first knuckle member that includes a first opening that receives an end of the first hollow pipe with a friction fit, a second opening, a first knuckle member body extending from the first opening to the second opening creating a first passageway from the first opening to the second opening; and (2) a second knuckle member that includes a third opening that receives a first end of the second hollow pipe, a fourth opening, a second knuckle member body extending from the third opening to the fourth opening creating a second passageway from the third opening to the fourth opening. The first passageway at the first opening may be oriented in a different direction than the first passageway at the second opening, and the second passageway at the third opening may be oriented in a different direction than the second passageway at the fourth opening. The first knuckle member may be selectively rotationally fixed to the second knuckle member or rotationally movable with the second knuckle member. When the first knuckle member and the second knuckle member are rotationally movable to each other, the first knuckle member and the second knuckle member may be rotationally movable to each other through 360 degrees. The knuckle assembly further comprises a bushing that includes a cylindrical bushing wall and a rib that extends outward from the bushing wall, where the rib is positioned a portion of the first knuckle member and a portion of the second knuckle member. The knuckle assembly may also include a first gasket received in a first groove located on a first outward facing surface of a first flange extending around the second opening of the first knuckle member, where the first outward facing surface extends from a perimeter edge of the first flange to an interior edge of the second opening; and a second gasket received in a second groove located on a second outward facing surface of the second flange extending around the fourth opening of the second knuckle member, where the second outward facing surface extends from a perimeter edge of the second flange to an interior edge of the fourth opening. The rib of the bushing may be located between the first gasket and the second gasket. The first flange may include a plurality of wavy teeth, where the plurality of wavy teeth comprises an undulating surface of peaks and valleys. The bushing wall may have a portion that extends and through the second opening of the first knuckle member and the fourth opening of the second knuckle member. The knuckle assembly may comprise a mechanical fastener that extends through a first side opening of the second knuckle member and also extending through a second side opening of the first knuckle member to connect the first knuckle member and the second knuckle member such that when a nut is tightened on the mechanical fastener, the first knuckle member may be rotationally fixed to the second knuckle member. And when the nut is loosened on the mechanical fastener, the first knuckle member may be rotationally movable with the second knuckle member. In some examples, a washer may be located between the nut and the second side opening, where the washer has a first washer surface that contacts an outer surface of the first knuckle member body adjacent the second side opening, wherein the first washer surface has a first coefficient of friction, and the outer surface of the first knuckle member has a second coefficient of friction, wherein the first coefficient of friction is less than the second coefficient of friction. The first knuckle member may be formed from a clear polymer material. The hollow articulating structure may also include a second knuckle assembly that comprises: (1) a third knuckle member that includes a fifth opening that receives a second end of the second hollow pipe with a friction fit, a sixth opening, a third knuckle member body extending from the fifth opening to the sixth opening creating a third passageway from the first opening to the second opening, (2) a fourth knuckle member that includes a seventh opening of the fourth knuckle member that receives a first end of a third hollow pipe, a fourth knuckle member body extending from the seventh opening to an eighth opening creating a fourth passageway from the seventh opening to the eighth opening, and (3) a hood connected to a second end of the third hollow pipe, where the hood is configured to be positioned in a location to provide suction from the vacuum source to a desired location. The third knuckle member may be selectively rotationally fixed to the fourth knuckle member or rotationally movable with the fourth knuckle member. The hollow articulating structure may also comprise a diverter that is connected to the vacuum source and also connected to the first hollow pipe and connected to a mount on a movable stand. The movable stand may comprise a second end of the diverter connected to the mount, where the mount includes a base with a central portion and a pair of upper flanges on opposite sides of the central portion, where the central portion is spaced below the pair of upper flanges and where the central portion has a smaller width at a rearward end and a larger width at a forward end, and where the movable stand further comprises a plurality of wheels. In some examples, the hollow articulating structure may include a diverter that is connected to the vacuum source and also connected to the first hollow pipe and connected to a stationary worksurface. In other examples, the hollow articulating structure may comprise a dust collector that is connected to the vacuum source and connected to the first hollow pipe.

Other aspects of this disclosure may relate to a hollow articulating structure configured to connect to a vacuum source that comprises: (a) a first hollow pipe connected to the vacuum source; (b) a second hollow pipe; and (c) a knuckle assembly comprising: (1) a first knuckle member that includes a first opening that receives an end of the first hollow pipe with a friction fit, a second opening, a first knuckle member body extending from the first opening to the second opening creating a first passageway from the first opening to the second opening, and a first flange extending around the second opening; and (2) a second knuckle member that includes a third opening that receives a first end of the second hollow pipe, a fourth opening, a second knuckle member body extending from the second opening to the fourth opening creating a second passageway from the third opening to the fourth opening, and a second flange extending around the fourth opening. The first flange may include a first groove located on a first outward facing surface, where the first outward facing surface extends from a perimeter edge of the first flange to an interior edge of the second opening, and the second flange may include a second groove located on a second outward facing surface, where the second outward facing surface extends from a perimeter edge of the second flange to an interior edge of the fourth opening. The first outward facing surface may face the second outward facing surface. The first knuckle member and the second knuckle member are selectively rotationally movable to each other, and where the first knuckle member and the second knuckle member is configured to be rotationally movable to each other through 360 degrees. The knuckle assembly may further comprise a bushing that includes a cylindrical bushing wall and a rib that extends outward from the bushing wall, where the rib is positioned between a portion of the first outward facing surface and a portion of the second outward facing surface. In addition, the knuckle assembly may include a first gasket received in the first groove of the first flange and positioned between the first flange and the rib of the bushing, and a second gasket received in the second groove of the second flange and positioned between the second flange and the rib of the bushing. In some examples, the hollow articulating structure may further include a second knuckle assembly, comprising: (a) a third knuckle member that includes a fifth opening that receives a second end of the second hollow pipe with a friction fit, a sixth opening, a third knuckle member body extending from the fifth opening to the sixth opening creating a third passageway from the first opening to the second opening; (b) a fourth knuckle member that includes a seventh opening that receives a first end of a third hollow pipe, a fourth knuckle member body extending from the seventh opening to an eighth opening creating a fourth passageway from the seventh opening to the eighth opening; and (c) a hood connected to a second end of the third hollow pipe, where the hood is configured to be positioned in a location to provide suction from the vacuum source to a desired location. The third knuckle member may be capable of being rotationally movable with the fourth knuckle member.

In still other aspects of this disclosure a knuckle assembly for a hollow articulating structure may comprise: (a) a first knuckle member that includes a first opening configured to receive an end of a first hollow pipe, a second opening, a first knuckle member body extending from the first opening to the second opening creating a first passageway from the first opening to the second opening, and a first flange extending around the second opening; (b) a second knuckle member that includes a third opening that is configured to receive an end of a second hollow pipe, a fourth opening, a second knuckle member body extending from the third opening to the fourth opening creating a second passageway from the third opening to the fourth opening, and a second flange extending around the fourth opening, and (c) a bushing that includes a cylindrical bushing wall and a rib that extends outward from the bushing wall, where the rib is positioned between a portion of the first knuckle member and a portion of the second knuckle member. The first flange may include a first groove on a first outward facing surface, and the second flange includes a second groove on a second outward facing surface. The first passageway at the first opening may be oriented in a different direction than the first passageway at the second opening, and the second passageway at the third opening is oriented in a different direction than the second passageway at the fourth opening. The first outward facing surface of the first flange may extend from a perimeter edge of the first flange to an interior edge of the second opening, and the second outward facing surface of the second flange may extend from a perimeter edge of the second flange to an interior edge of the fourth opening. The first knuckle member may be selectively rotationally fixed to the second knuckle member or rotationally movable with the second knuckle member, and when the first knuckle member and the second knuckle member are rotationally movable to each other. In addition, the first knuckle member and the second knuckle member may be rotationally movable to each other through 360 degrees. The knuckle assembly may include a first gasket received in the first groove of the first outward facing surface and a second gasket received in the second groove of the second flange, where the rib may be positioned between the first gasket and the second gasket. The first flange may include a plurality of wavy teeth, where the plurality of wavy teeth comprises an undulating surface of peaks and valleys.

DESCRIPTION OF THE DRAWINGS

To allow for a more full understanding of the present disclosure, it will now be described by way of example, with reference to the accompanying drawings in which.

DETAILED DESCRIPTION

Figure 1:
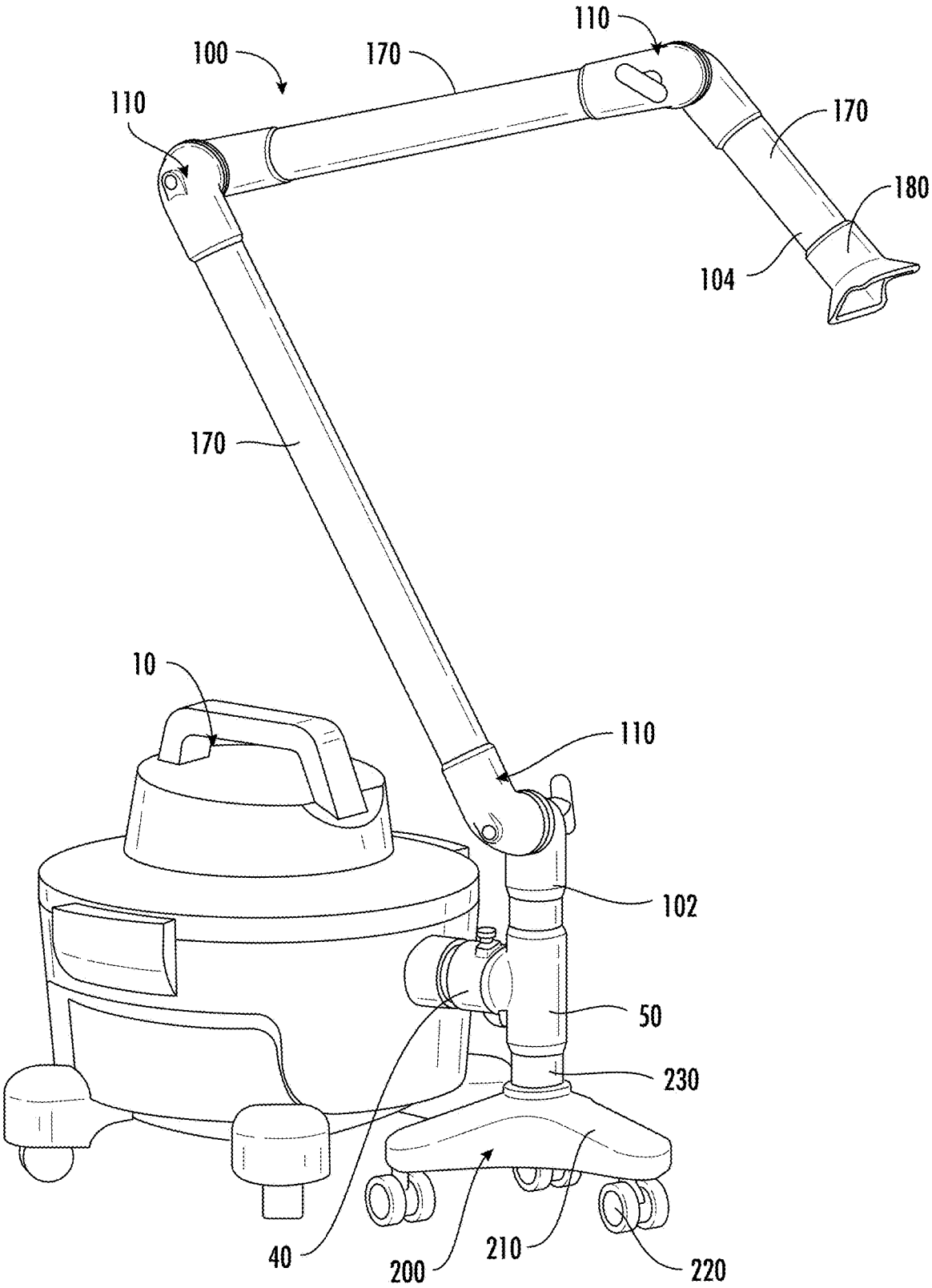
FIG. 1 illustrates a perspective view of an exemplary hollow articulating structure attached to a portable vacuum, in accordance with aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Also, while the terms "top," "side," "distal," and the like may be used in this specification to describe various example features and elements of the invention, these terms are used herein as a matter of convenience, e.g., based on the example orientations shown in the figures or the orientation during typical use. Nothing in this specification should be construed as requiring a specific three-dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Plurality," as used herein, indicates any number greater than one, either disjunctively or conjunctively, as necessary, up to an infinite number.

"Substantially perpendicular" means that a first line, segment, plane, edge, surface, etc. is approximately (in this instance, within 5%) 90 degrees from with another line, plane, edge, surface, etc., over at least 50% of the length of the first line, segment, plane, edge, surface, etc.

In general, this disclosure relates to a hollow articulating structure that is configured to attach to a vacuum source to allow a user to accurately position the hood or end opposite the vacuum source in the desired location.

Figure 2:
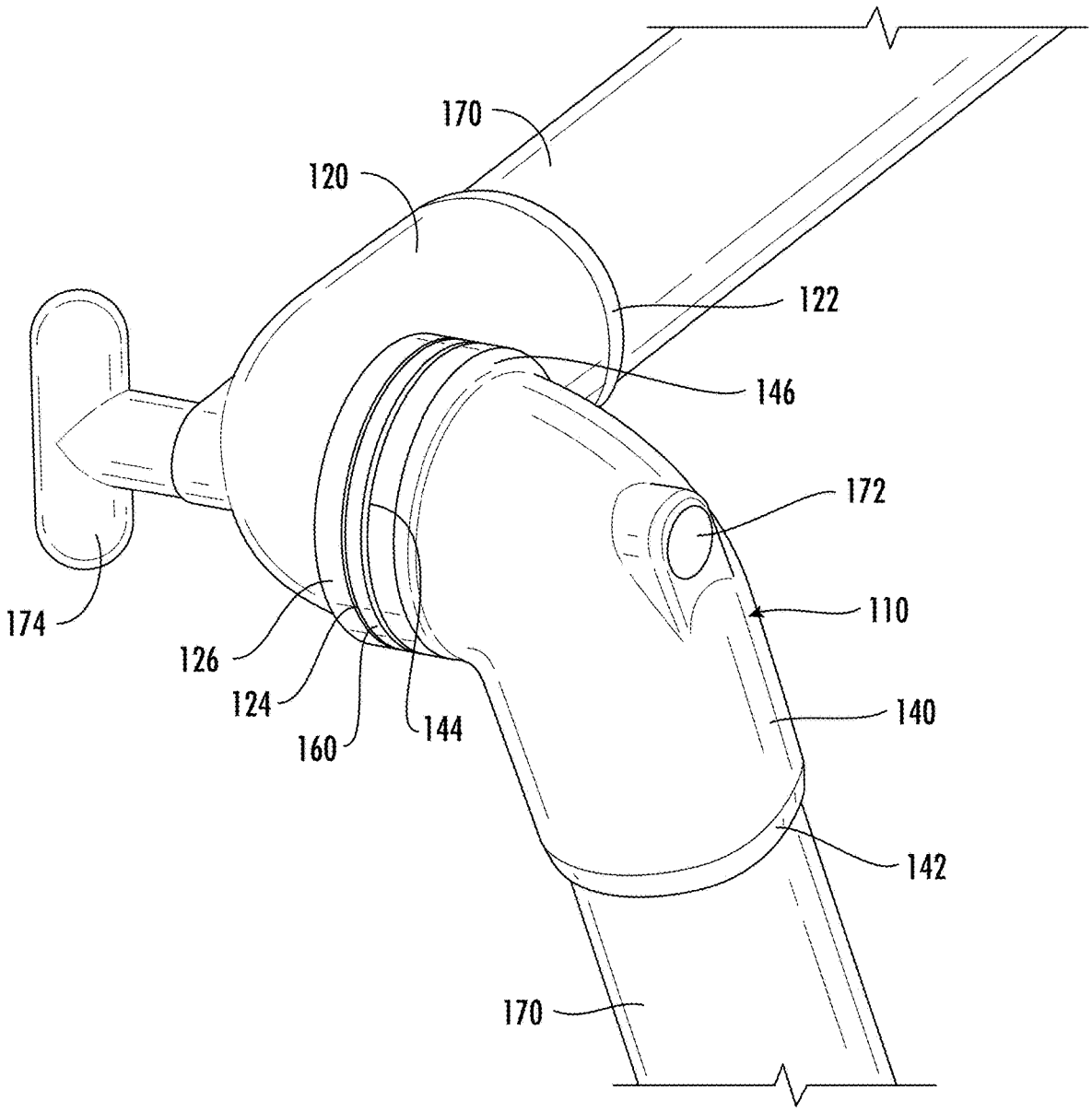
FIG. 2 illustrates a perspective view of a portion of the hollow articulating structure of FIG. 1, in accordance with aspects of the disclosure.
Figure 3:
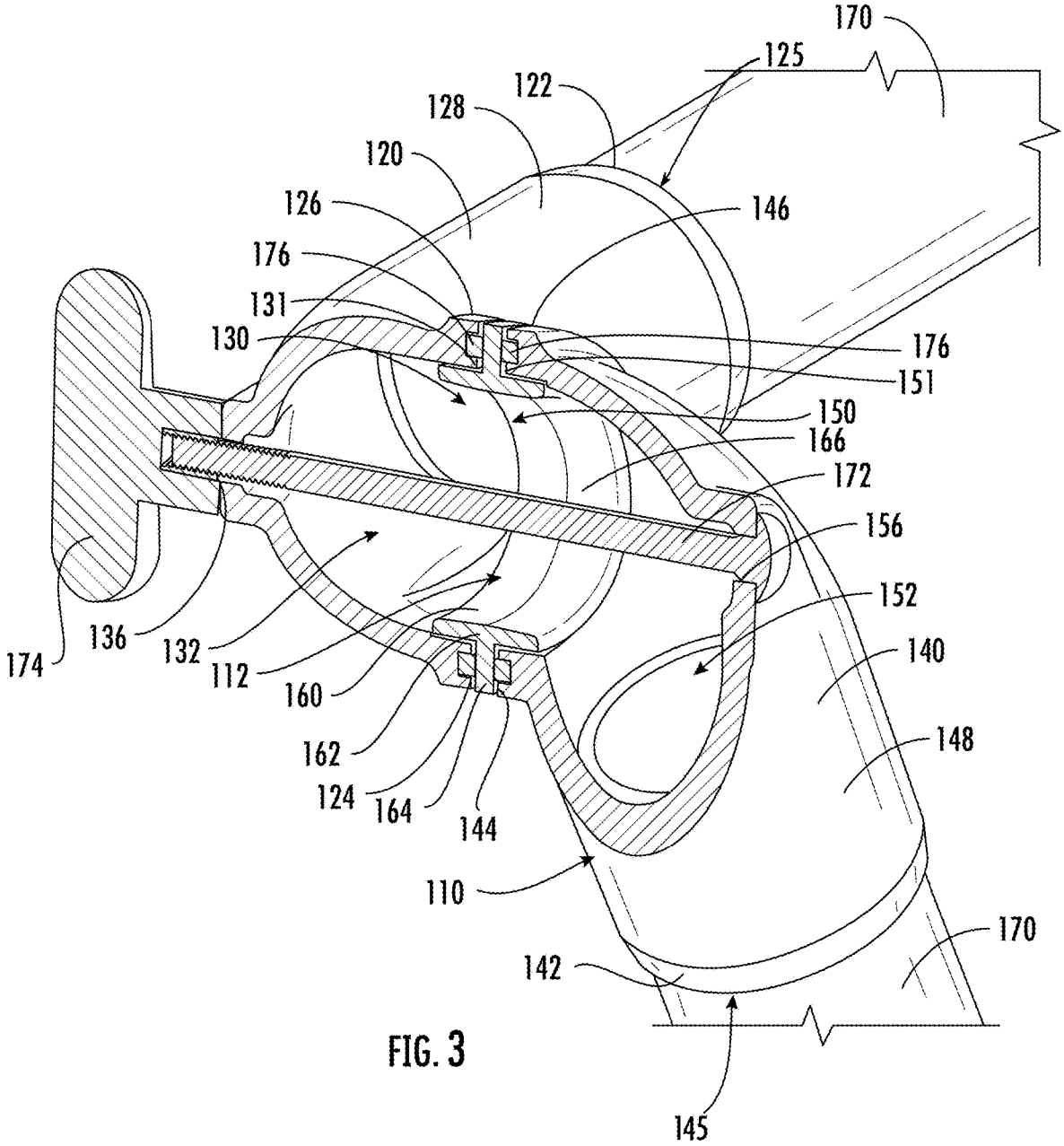
FIG. 3 illustrates a cross-sectional perspective view of the portion of the hollow articulating structure of FIG. 2, in accordance with aspects of the disclosure.

FIGS. 1-3 illustrate an exemplary hollow articulating structure 100. In FIG. 1, the hollow articulating structure 100 is illustrated when connected to a vacuum source 10. While the vacuum source 10 is shown as a portable vacuum, the vacuum source 10 may be a stationary or portable vacuum source. As shown in FIG. 1, the vacuum source 10 may be attached to an adapter 40 and diverter 50 to allow the vacuum source 10 to connect to the articulating structure 100 at its first end 102. Alternatively, the hollow articulating structure 100 may be connected directly to the vacuum source 10. The hollow articulating structure 100 may have a plurality of movable joints or knuckle assemblies 110 that are positioned between rigid or flexible pipes 170 to allow a user to move each knuckle assembly 110 individually to position the distal end 104 of the articulating structure 100 in the desired location to allow suction from the vacuum source 10 to create an airstream through the hollow articulating structure 100 to move dust or other particles through the hollow articulating structure 100 to the vacuum source 10 where it can be collected. The end 104 may include a hood 180 that is removably connected to one of the pipes 170 and is configured to direct the suction from the vacuum source 10 in a desired manner. The diverter 50 and/or the hollow articulating structure 100 may be releasably connected to a movable stand 200 that will be discussed in more detail below.

The hollow articulating structure 100 may comprise at least one knuckle assembly 110 and at least two pipes 170. In some examples, the hollow articulating structure 100 may include a plurality of knuckle assemblies 110 and a plurality of pipes 170 with a hood 180 connected an end of the articulating structure 100 opposite the vacuum source 10. The hood 180 may have different shapes to provide an inlet for the dust particles to travel through the hollow articulating structure 100. The pipes 170 may have different lengths or may all be the same length. In addition, the pipes 170 may be adjusted to a desired length by the user (i.e. the user may cut the pipes 170 to the desired length). Further, each pipe 170 may be releasably connected to the knuckle assembly 110.

Each knuckle assembly 110 may include a first knuckle member 120, a second knuckle member 140, and a bushing 160 positioned between the two knuckle members 120, 140 that are connected together. The first knuckle member 120 and the second knuckle member 140 can be rotationally fixed or rotationally movable relative to each other. Each knuckle member 120, 140 can be rotated fully around its corresponding knuckle member, such that each knuckle member 120, 140 can rotate 360 degrees around each other. In addition, each knuckle member 120, 140 may be hollow where each knuckle member 120, 140 has a passageway 132, 152 respectively. When the knuckle members 120, 140 are connected together the two passageways 132, 152 join together to form a knuckle assembly passageway 112 that extends through the knuckle assembly 110 to allow a fluid (e.g. air or liquid) to move through the knuckle assembly 110 back to the vacuum source 10. Thus, the airflow passes through the first end 142 of the second knuckle member 140 through the first end 122 of the first knuckle member 120 and through the knuckle assembly passageway 112.

Each knuckle member 120, 140 may be releasably connected to each pipe 170 via a friction fit. The openings at the first end 122, 142 of the respective knuckle members 120, 140 may be sized match an outer diameter of the pipe 170. The openings at the first ends 122, 142 may have a slight taper to allow each pipe 170 to be received and retained within its respective opening. In some cases, the knuckle members 120, 140 may be formed from a material that allows the openings to elastically deform to retain the pipes 170. Similarly, the hood 180 may be releasably connected to the pipe 170 using a friction fit at the end of the articulating structure 100.

As best shown in FIGS. 2 and 3, the first knuckle member 120 may comprise a first opening 125 at a first end 122, where the first opening 125 releasably receives a hollow pipe 170 using a friction fit, a second end 124 with a second opening 130, and a first knuckle member body 128 that extends between the first end 122 and the second end 124 creating a passageway 132 from the first opening 125 to the second opening 130. The first knuckle member 120 may further include a flange 126 that extends around the second opening 130, where the flange 126 includes a groove on an outward facing surface 131 of the flange 126. The outward facing surface 131 may extend from a perimeter edge of the flange 126 to an interior edge of the second opening 130. The passageway 132 may be oriented in a different direction at the first opening 125 than at the second opening 130. For example, the direction of the passageway 132 at the first opening 125 may be substantially perpendicular to the direction of the passageway 132 at the second opening 130.

Similarly, the second knuckle member 140 may comprise a first opening 145 at a first end 142, where the first opening 145 releasably receives a hollow pipe 170 using a friction fit, a second end 144 with a second opening 150, and a second knuckle member body 148 that extends between the first end 142 and the second end 144 creating a passageway 152 from the first opening 145 to the second opening 154. The second knuckle member 140 may further include a flange 146 that extends around the second opening 150, where the flange 146 includes a groove on an outward facing surface 151 of the flange 146. The outward facing surface 151 may extend from a perimeter edge of the flange 146 to an interior edge of the second opening 150. The outward facing surfaces 131 of the flange 126 may face the outward facing surface 151 of the flange 146. The passageway 152 may be oriented in a different direction at the first opening 145 than at the second opening 154. For example, the direction of the passageway 152 at the first opening 145 may be substantially perpendicular to the direction of the passageway 152 at the second opening 150.

The pair of knuckle members 120, 140 may be joined together with a bushing 160 positioned between the two members 120, 140. In the illustrated examples, the bushing 160 may include a rib 164 that extends outward from the cylindrical bushing wall 162, where the rib 164 is positioned between the flange 126 of the first knuckle member 120 and the flange 146 of the second knuckle member 140. The bushing 160 may include an opening 166 that has a diameter that is the same diameter as the inner diameter of the pipe 170 to not impede or reduce the airstream flow through passageway 112 of the knuckle assembly 110. The bushing 160 may be formed from a polymer material, such as acetal, or other similar material. The rib 164 helps to prevent wear between the two knuckle members 120, 140 by keeping the two flanges 126, 146 (and the knuckle members 120, 140) from contacting each other.

As shown in FIG. 3, the knuckle assembly 110 may further include a mechanical fastener arrangement to secure the knuckle members 120, 140 together. A mechanical fastener 172 may extend through a side opening 156 of the second knuckle member 140 and also through a side opening 136 of the first knuckle member 120. A corresponding mechanical fastener 174 (i.e. a nut or corresponding fastener to mechanical fastener 172) may connect to the mechanical fastener 172 to apply or release pressure on the knuckle members 120, 140. For instance, when the mechanical fastener 174 is tightened, the knuckle members 120, 140 may be rotatably and laterally fixed such that the knuckle members 120, 140 are restrained from moving relative to each other. However, if the mechanical fastener 174 is loosened to release pressure between the knuckle members 120, 140, the knuckle members 120, 140 are rotatably (and possibly laterally) movable relative to each other. This rotatably movable connection allows a user to adjust the positions of each knuckle member 120, 140 independently. As the knuckle members 120, 140 move relative to each other, the pipes 170 that are connected at the first ends 122, 142 move with their corresponding knuckle members 120, 140.

In some examples, each flange 126, 146 and each side of the rib 164 may have teeth that interlock with each other to provide a more secure joint when the two knuckle members 120, 140 are rotationally fixed, when the mechanical fasteners 172, 174 are tightened together. Alternatively, each flange 126, 146 and each side of the rib 164 may have a smooth surface finish, or in some instances, the sides of the rib 164 may have a textured or knurled surface finish.

In addition, an annular gasket 176 may be received in the grooves that are arranged in the outward facing surfaces 131, 151 of respective flanges 126, 146. The gaskets 176 may be formed from an elastomeric material, such as ethylene propylene diene monomer (EPDM) rubber. The gaskets 176 may compress onto the rib 164 of the bushing 160 when the mechanical fasteners 172, 174 are in a tightened configuration to create a seal to prevent any leakage of air through the knuckle assembly 110. In addition, the bushing wall 162 may have a portion that extends and overlaps through each of the second openings 130, 150 to reinforce the joint between the knuckle members 120, 140 and also create a cover over the joint to further prevent any air leakage. In some examples, the mechanical fasteners 172, 174 may be tightened enough to prevent movement between the two knuckle members 120, 140 (i.e., the knuckle members 120, 140 are rotationally fixed), but a gap or space may still be present between the flanges 126, 146. In these instances, the friction between the gaskets 176 and the rib 164 of the bushing 160 may prevent rotational movement between the two knuckle members 120, 140 until the knuckle members are acted upon by an outside force.

Figure 4:
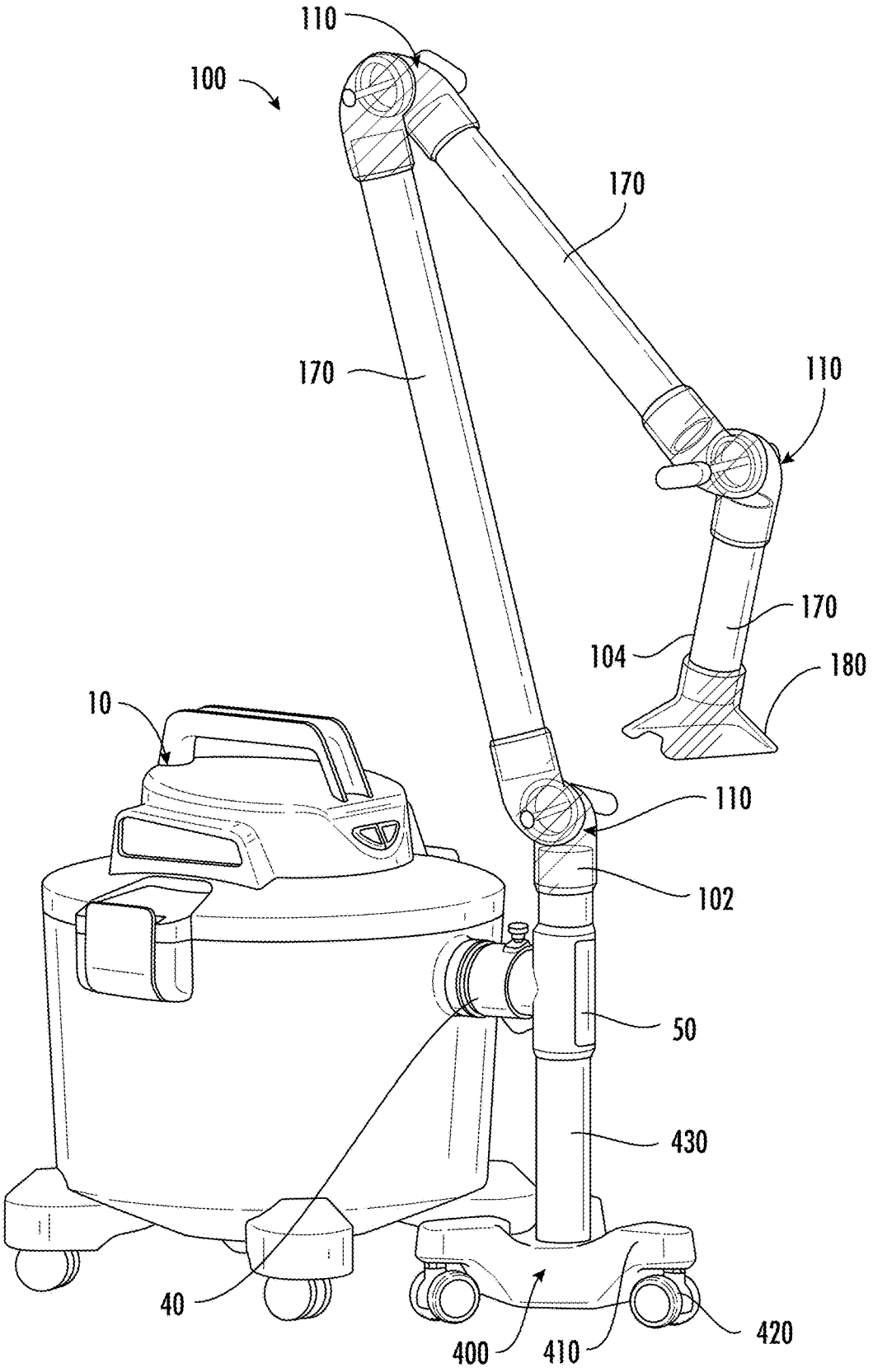
FIG. 4 illustrates a perspective view of an alternate exemplary hollow articulating structure attached to a portable vacuum, in accordance with aspects of the disclosure.

Each knuckle member 120, 140 and the hood 180 may be formed from a polymer material and may be formed using a molding technique such as injection molding, rotational molding, or other molding technique known to one skilled in the art. In some examples, the knuckle members 120, 140 and the hood 180 may be formed from polycarbonate or other clear polymer to allow a user to see if any obstruction is present within the knuckle assembly 110 or hood 180 as shown in FIG. 4. In some examples, the pipes 170 may also be formed from a clear polymer material. The knuckle members 120, 140 may be substantially identical such that the both knuckle members 120, 140 may be formed in the same molding tool.

The plurality of pipes 170 may be formed from a polymer material, and in some examples may be formed from polyvinyl chloride (PVC). Each pipe 170 may have a generally constant wall thickness. In some examples, the pipe 170 may have an internal diameter of approximately 1.5 inches, or may have an internal diameter of approximately 1.7 inches. In other examples, the pipe 170 may have an internal diameter of approximately 3.0 inches, or within a range of 0.5 inches and 4 inches. While in other examples, the pipes 170 may have larger or smaller internal or exterior diameters.

The movable stand 200 may include a base 210, a plurality of casters or wheels 220, and a mount 230. The movable stand 200 may be formed from a non-metallic material such as a polymer and may have a hollow internal cavity that can be filled with a material to add weight to help stabilize the movable stand 200 by keeping the center of gravity of the combination of the articulating structure 100 and the movable stand 200 lower to the ground. In some cases, the base 210 may be molded using a rotational molding technique. The mount 230 may have the same diameter as the pipe 170 and may releasably attach to a diverter 50, which in turn connects to the hollow articulating structure 100.

Figure 5A:
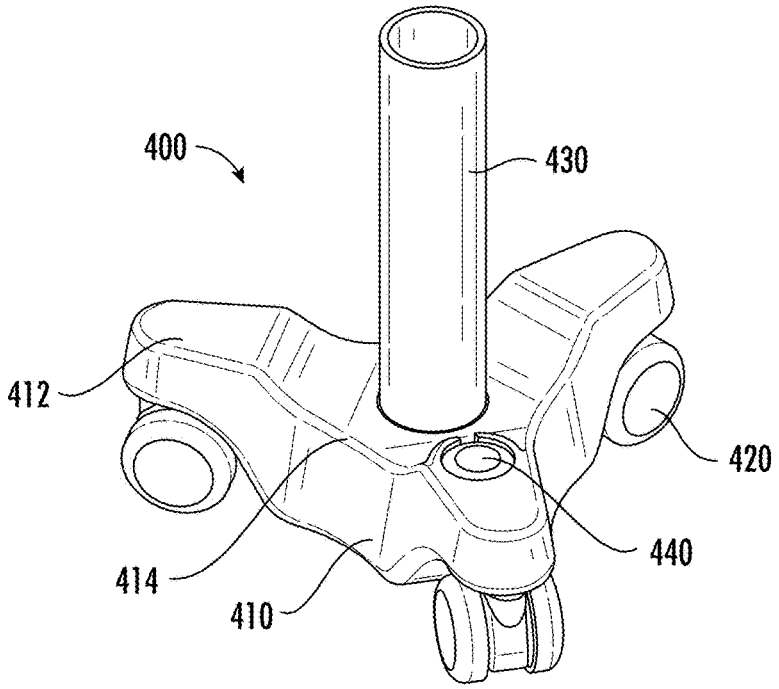
FIG. 5A illustrates a perspective view of a movable stand that releasably connects to the hollow articulating structure, in accordance with aspects of this disclosure.
Figure 5B:
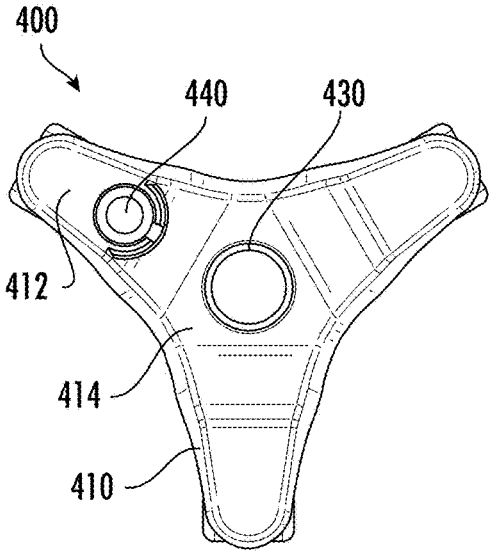
FIG. 5B illustrates a top view of the movable stand of FIG. 5A, in accordance with aspects of the disclosure.
Figure 5C:
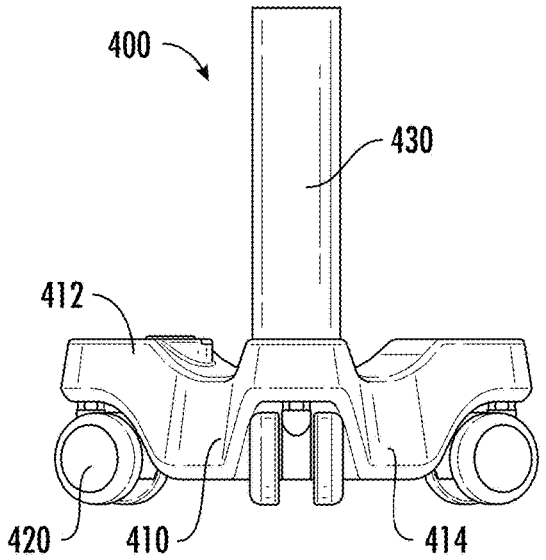
FIG. 5C illustrates a front view of the movable stand of FIG. 5A, in accordance with aspects of the disclosure.

As shown in the FIG. 4, the diverter 50 and/or the hollow articulating structure 100 may be releasably connected to an alternate movable stand 400. As shown in FIGS. 5A-5C, the movable stand 400 may include a base 410, a plurality of casters or wheels 420, and a mount 430. The movable stand 400 may be formed from a polymeric material and may have a hollow internal cavity that can be filled with a material to add weight to help stabilize the movable stand 400 by keeping the center of gravity of the combination of the articulating structure 100 and the movable stand 400 lower to the ground. A cap 440 may be located on the base 410 to allow access to the internal cavity so it may be filled with the weighted material. The base 410 may have a generally triangular shape with three distinct legs 412. Each set of casters 420 may be arranged near the end of each leg 412. A central portion 414 of the base 410 may be lower than a distal end of each leg 412 to help lower the center of gravity of the movable stand 400. The mount 430 may comprise a hollow structure and may have the same diameter as the pipe 170 to releasably attach to a diverter 50, which in turn connects to the hollow articulating structure 100. The movable stand 400 may also include a braking mechanism to lock at least one or more casters 420 to prevent any unwanted movement of the movable stand 400. In some cases, the base 410 may be molded using a rotational molding technique using a polymeric or non-metallic material.

The movable stands 200,400 are designed to provide a stable platform to help minimize any tipping of the hollow articulating structure 100 as it is moved. The base 210, 410 (i.e. the positioning of the legs 412 or size of the base 210, 410) of each movable stand 200, 400 may help to position the casters 220, 420 in a manner to minimize any potential tipping of the articulating structure 100. In addition, the movable stands 200, 400 may be configured to work with a plurality of portable vacuum sources 10, such a plurality of wet/dry shop vacuums or mobile dust collectors or dust extractors.

The adapter 40 may have a body with a first portion adapted for releasable connection with the diverter 50 and the second portion that is adapted for a releasable connection with a plurality of hoses that connect to the vacuum source 10 or adapted for a releasable connection directly to the vacuum source 10. The adapter 40 may be similar to the adapter described in U.S. patent application Ser. No. 17/088,064 filed on Nov. 3, 2020, which is incorporated by reference herein in its entirety.

Figure 6:
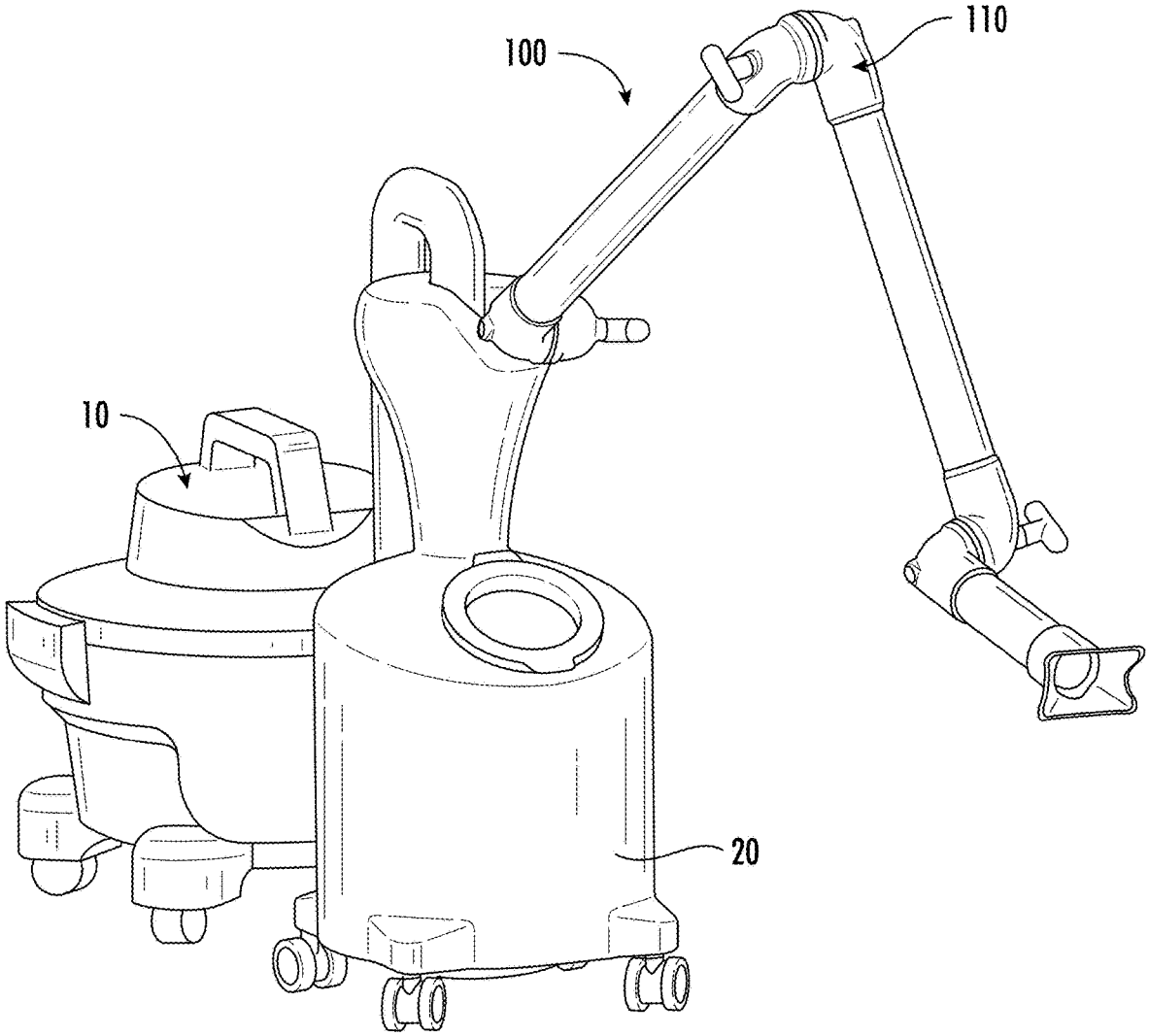
FIG. 6 illustrates a perspective view of the exemplary hollow articulating structure attached to a dust collector, where the dust collector is connected to a portable vacuum, in accordance with aspects of the disclosure.
Figure 7:
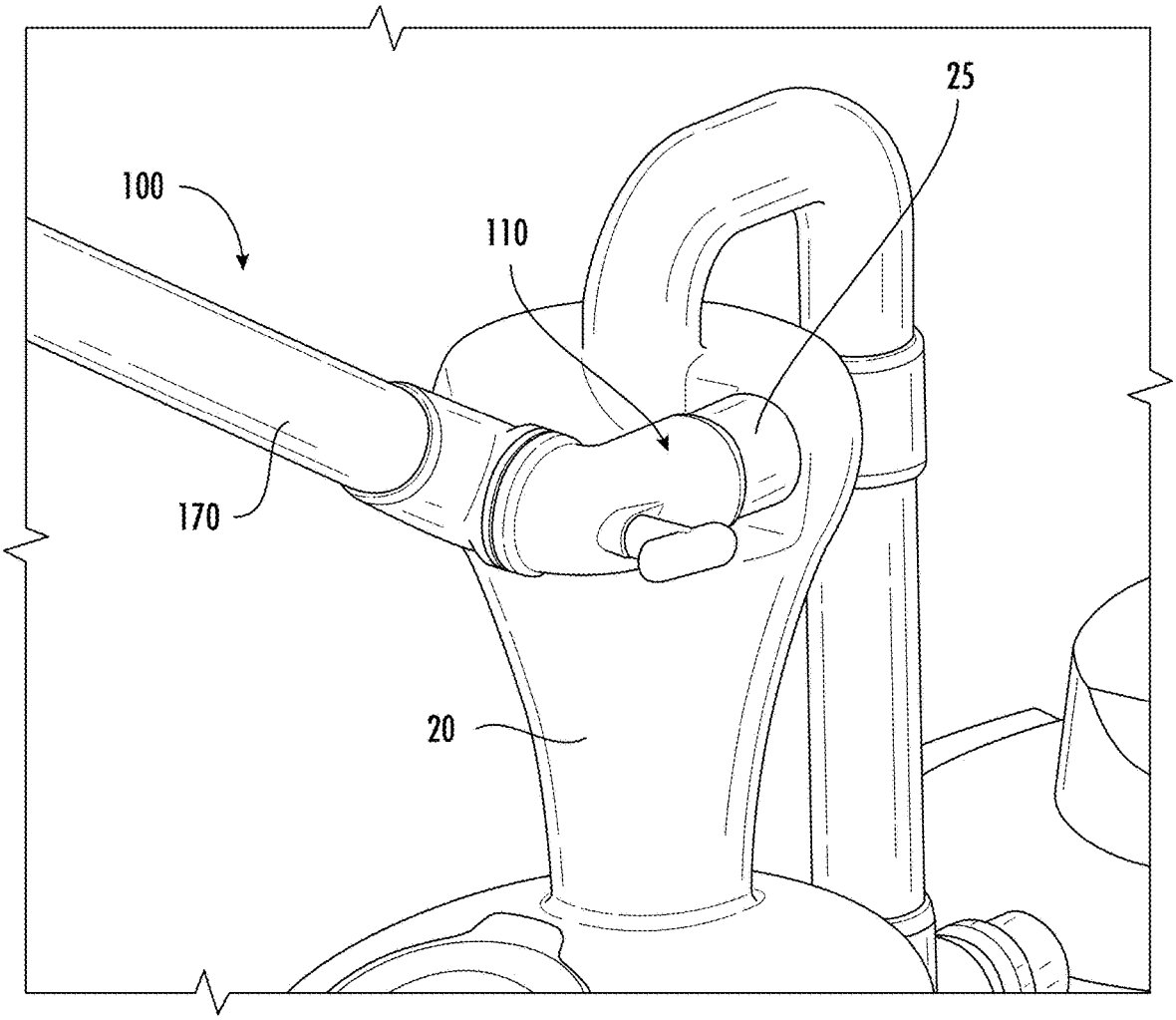
FIG. 7 illustrates a perspective view of a connection of the hollow articulating structure to the dust collector shown in FIG. 6, in accordance with aspects of the disclosure.

FIGS. 6 and 7 illustrate the articulating structure 100 connected to a portable dust separator 20 prior to the connecting to the vacuum source 10. The knuckle assembly 110 of the articulating structure 100 may releasably connect to the inlet 25 the dust separator 20 to the opening at the first end 122 of the knuckle member 120 via a friction fit. The dust separator and/or dust collector 20 may be similar to the dust separator and collector described in U.S. application Ser. No. 17/327,697 filed on May 22, 2022, which is incorporated herein by reference.

Figure 8:
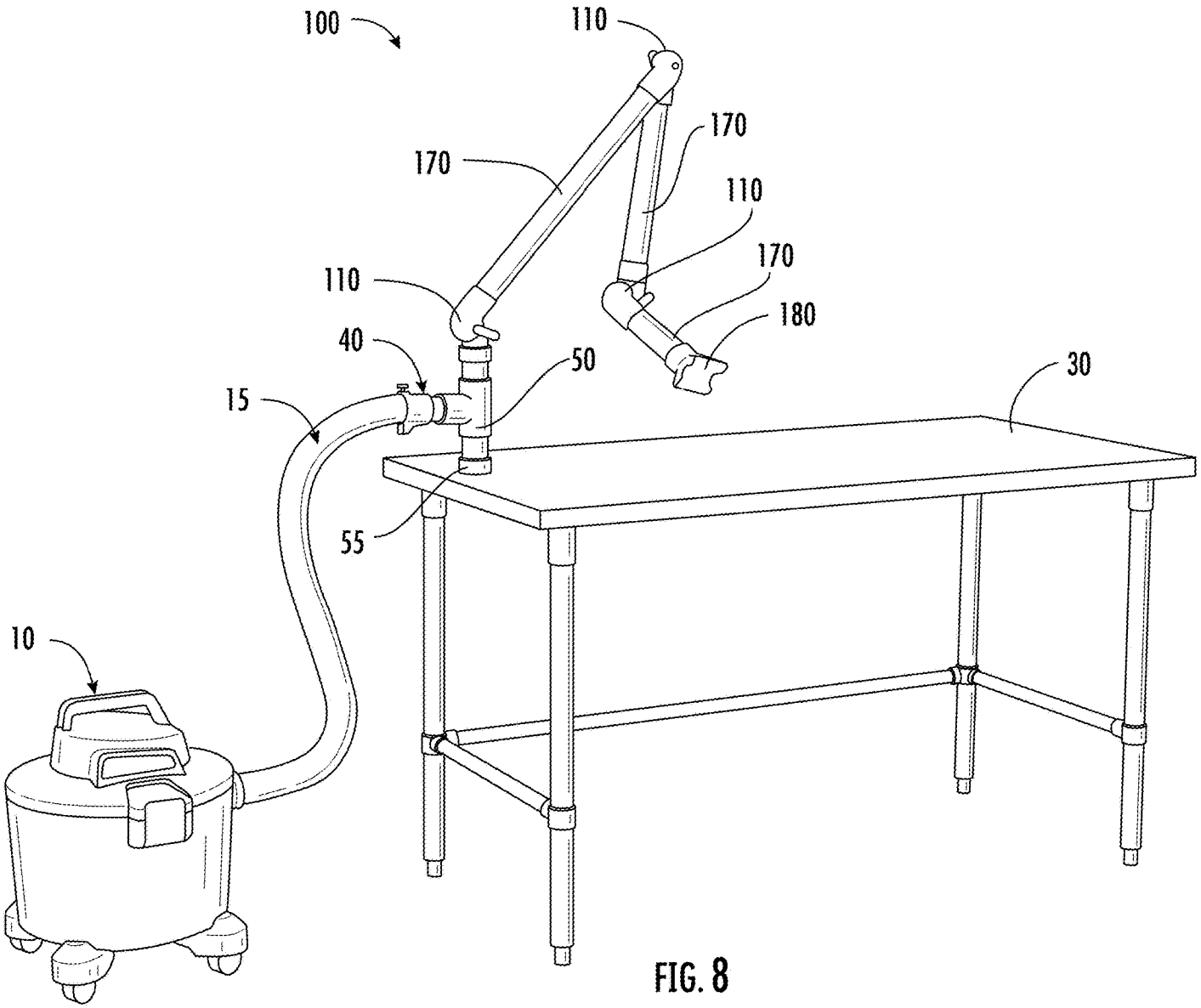
FIG. 8 illustrates a perspective view of an arrangement of an exemplary hollow articulating structure mounted to a worksurface, in accordance with aspects of the disclosure.

FIG. 8 illustrates another example of the hollow articulating structure 100. In the example shown in FIG. 8, the articulating structure 100 is connected to a vacuum source 10 via an adapter 40 that is connected to a diverter 50, where the diverter 50 is fixedly connected to a table or other stationary worksurface 30 using a table mount 55. The adapter 40 may releasably connect the hose 15 from the vacuum source 10 to the diverter 50. The hollow articulating structure 100 may comprise a plurality of movable or rotatable knuckle assemblies 110 positioned between rigid or flexible pipes 170 to allow a user to move each knuckle assembly 110 individually to position the hood 180 to a desired location to provide suction from the vacuum source 10. The suction from the vacuum source 10 may create an airstream through the hollow articulating structure 100 to move dust or other particles through the hollow articulating structure 100 to the vacuum source 10 where it can be collected. By mounting the articulating structure 100 to a top of the worksurface 30 a user may have access to the suction from the vacuum source 10 without taking up additional space on the worksurface 30. In some examples, the table mount 55 may be completely off the worksurface 30 where the table mount 55 is connected to a side of the worksurface 30.

The hollow articulating structure 100 may move upward from the worksurface 30 and then be positioned to reach any areas on the worksurface 30 by manipulating the plurality of knuckle assemblies 110. For example, a first knuckle assembly 110 may be connected to the diverter 50 with a first pipe 170 extending from the first knuckle assembly 110 to a second knuckle assembly 110. A second pipe 170 may be connected to the second knuckle assembly and be positioned between the second knuckle assembly 110 and a third knuckle assembly 110. From the third knuckle assembly 110, a third pipe that may be connected to hood 180. While this configuration includes three knuckle assemblies 110, the number of knuckle assemblies 110 and pipes 170 may vary depending on the space to be covered and the amount of movement needed from the hollow articulating structure 100.

Figure 9:
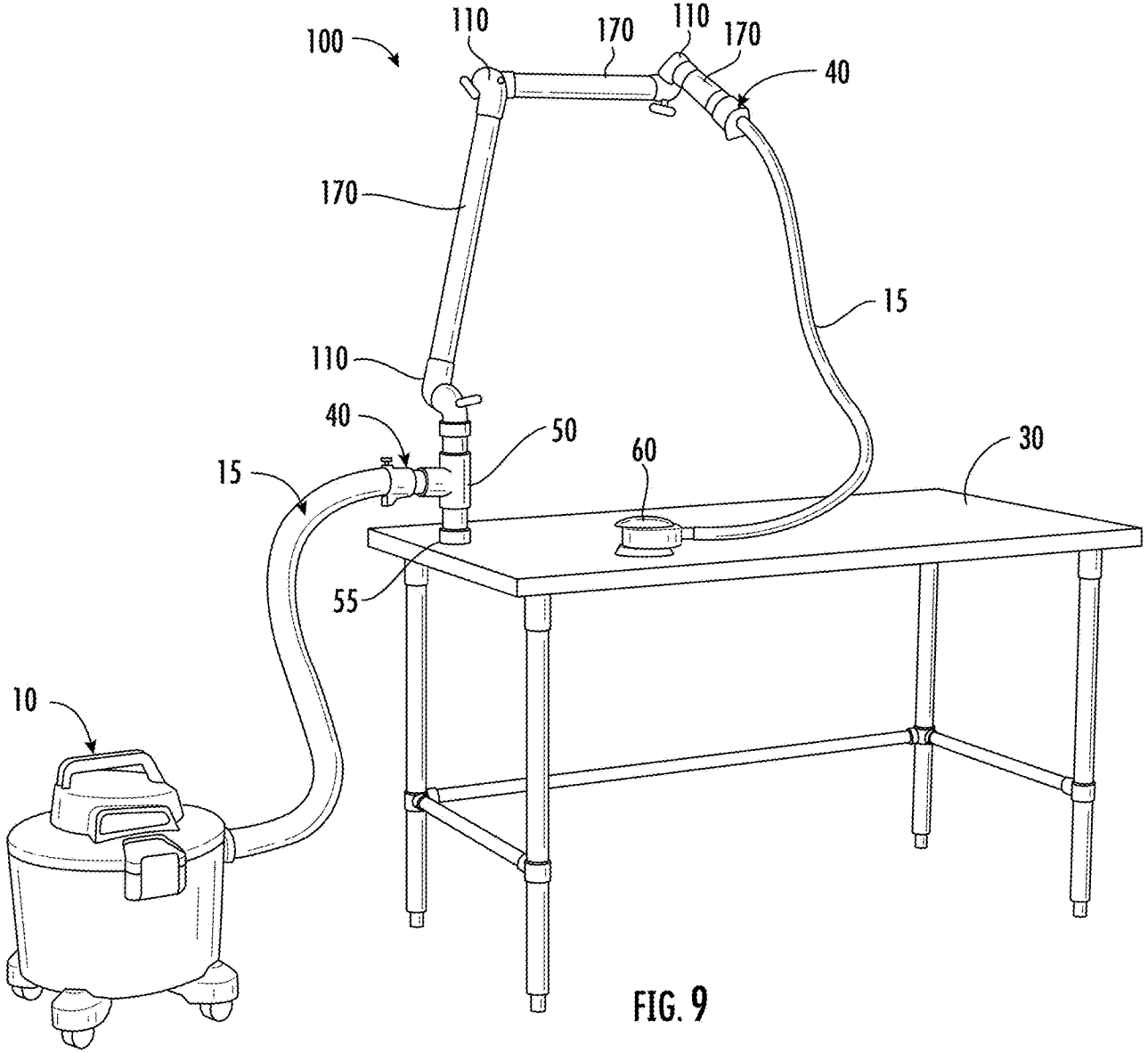
FIG. 9 illustrates a perspective view of an arrangement of an exemplary hollow articulating structure mounted to a worksurface and adapted to provide suction to a portable tool, in accordance with aspects of the disclosure.

FIG. 9 illustrates another example of the hollow articulating structure 100 mounted to a worksurface 30 in a similar manner to the hollow articulating structure 100 shown in FIG. 8. The articulating structure 100 may be connected to a vacuum source 10 via an adapter 40 in a similar manner to the articulating structure 100. As an option, the hood 180 may be replaced with an adapter 40 that connects to a hose 15 that is connected to a portable sander 60 or other portable tool such that the hollow articulating structure 100 provides suction from the vacuum source 10 to the portable tool 60.

Figure 10:
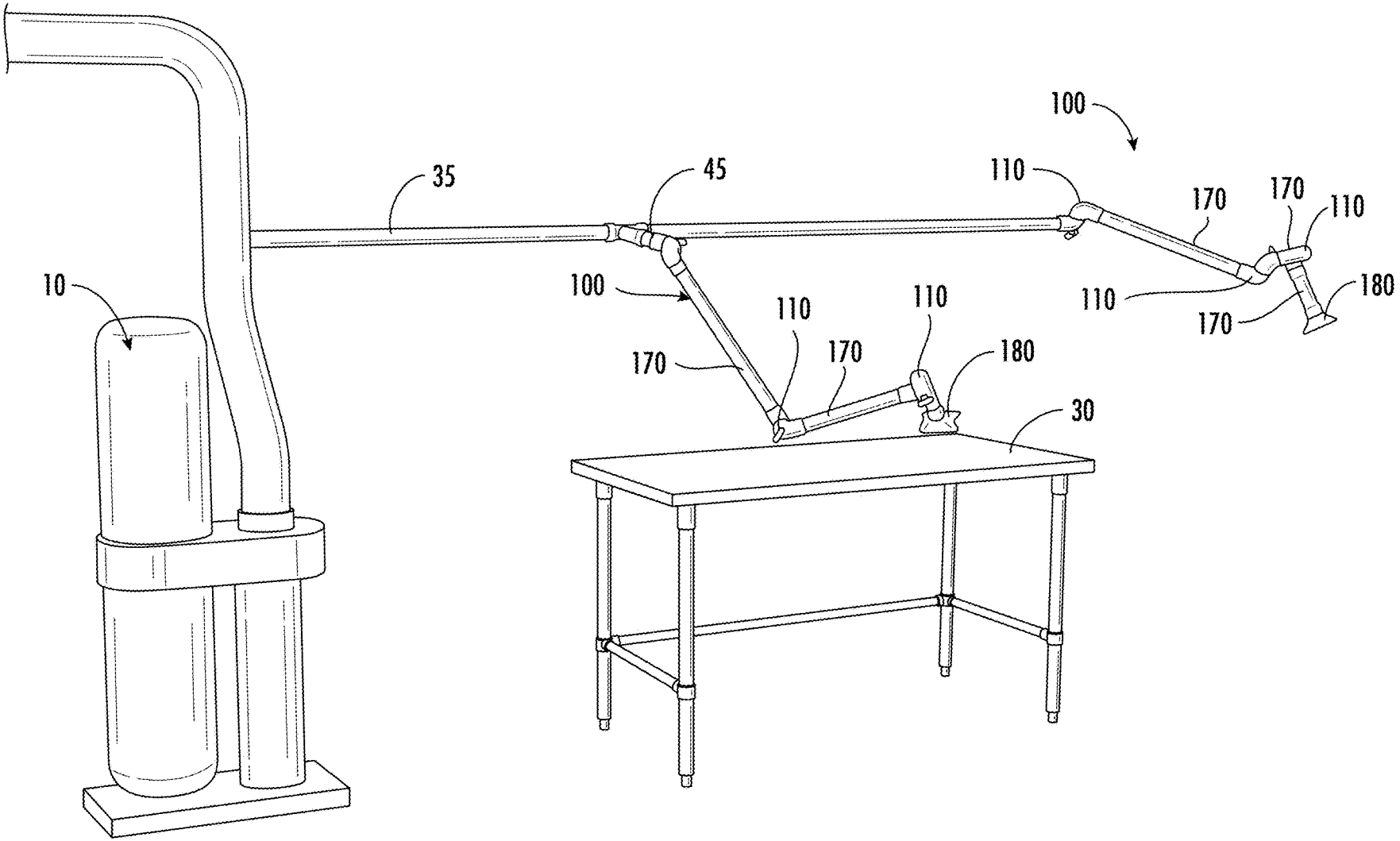
FIG. 10 illustrates a perspective view of an arrangement of exemplary hollow articulating structures connected to a wall mounted pipe connected a vacuum source, in accordance with aspects of the disclosure.

FIG. 10 illustrates another exemplary arrangement that utilizes a plurality of hollow articulating structures 100 connected to piping 35 that is connected to a stationary vacuum source 10. The piping 35 may be connected to a wall or ceiling. In the illustrated example, the piping 35 may have a joint 45 that may be a Y-shaped joint where a first hollow articulating structure 100 connects to the joint 45 while a second hollow articulating structure 100 may connect at a second location on the piping 35 to provide suction through the hood 180 on each of the hollow articulating structures 100. Similar to described above, each hollow articulating structure 100 may include a plurality of knuckle assemblies 110 that are connected on each end to a pipe 170, where the pipe 170 at the distal end is connected to a hood 180 that provides suction that can be directed to the desired location by a user. While the illustrated example shows a pair of hollow articulating structures 100, the arrangement may include more than two articulating structures 100 depending on the length of the piping 35 and the power of the vacuum source 10.

Figure 11:
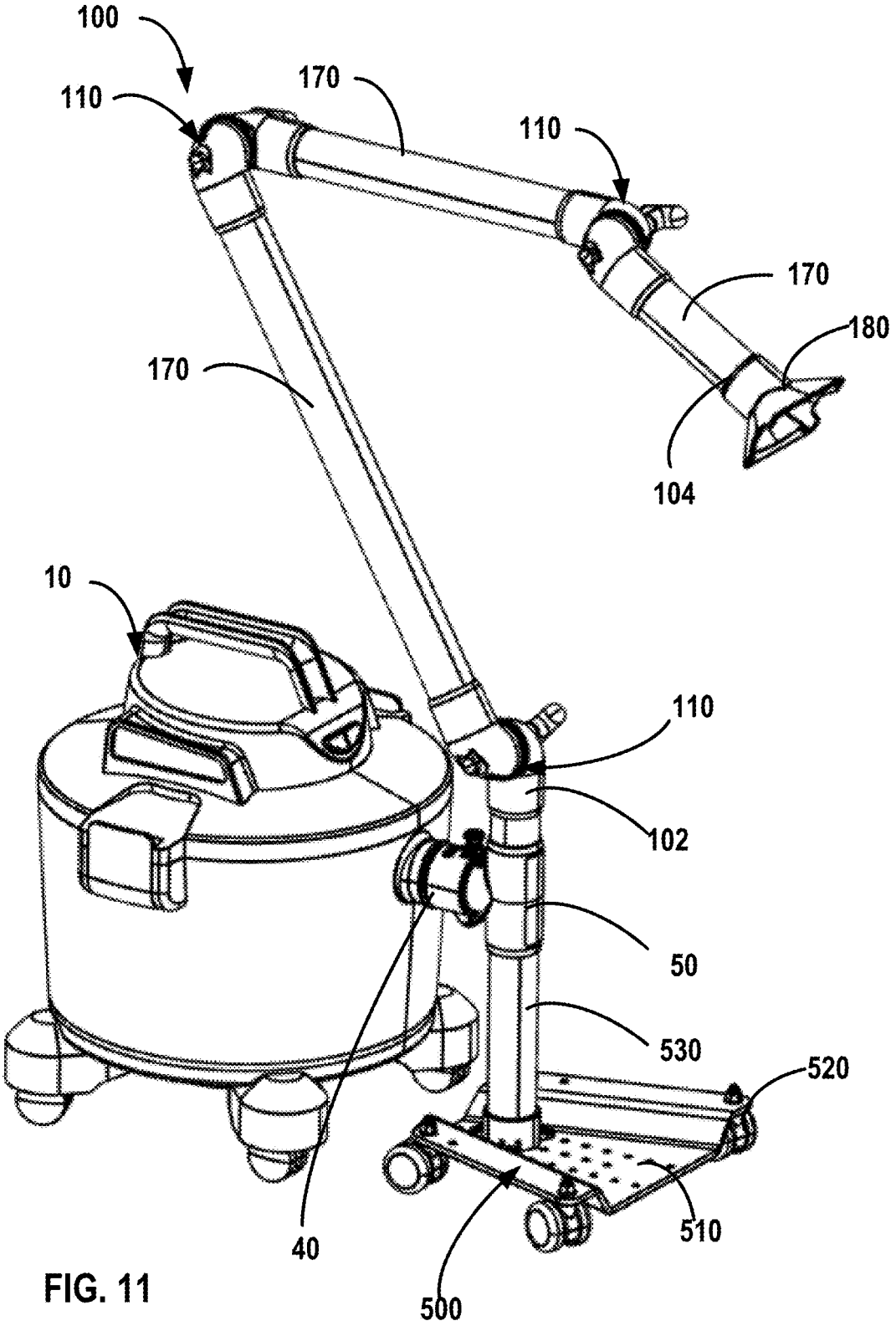
FIG. 11 illustrates a perspective view of an alternate exemplary hollow articulating structure attached to a portable vacuum, in accordance with aspects of the disclosure.
Figure 12A:
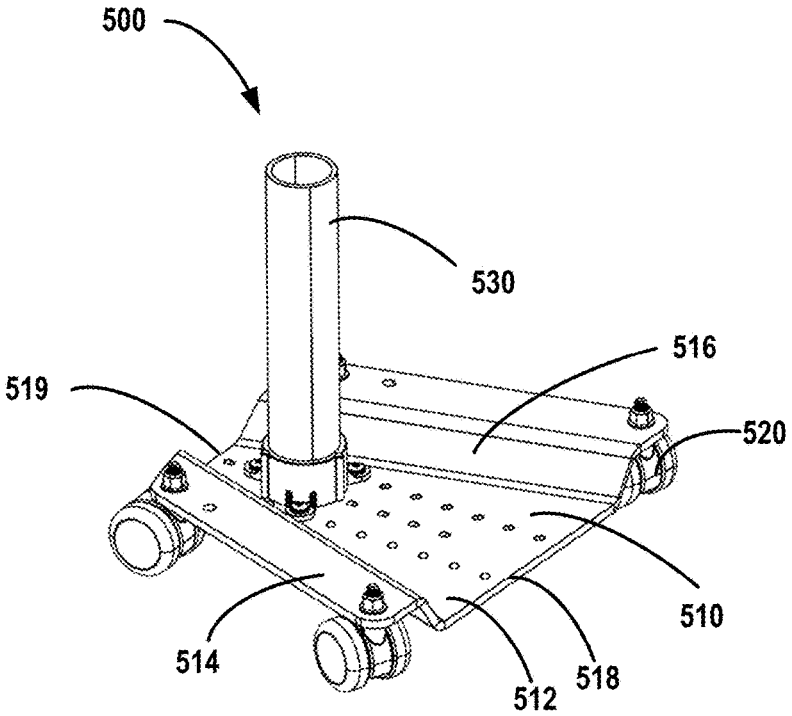
FIG. 12A illustrates a perspective view of a movable stand that releasably connects to the hollow articulating structure of FIG. 11, in accordance with aspects of this disclosure.
Figure 12B:
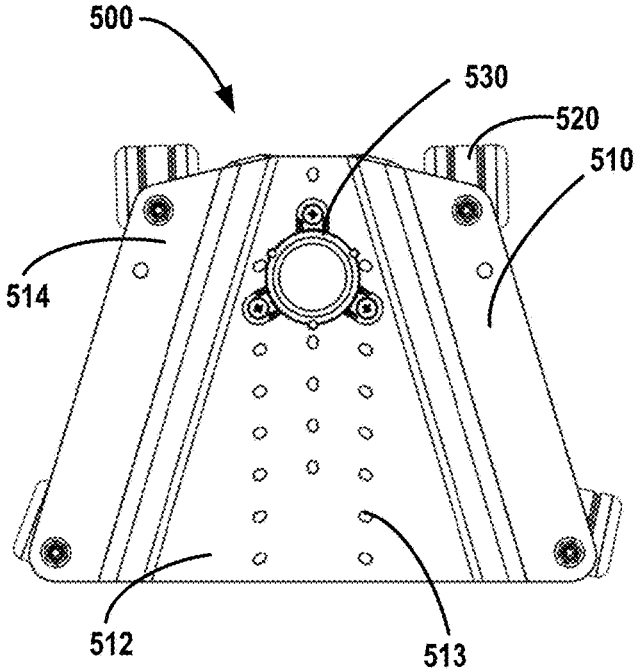
FIG. 12B illustrates a top view of the movable stand of FIG. 12A, in accordance with aspects of the disclosure.
Figure 12C:
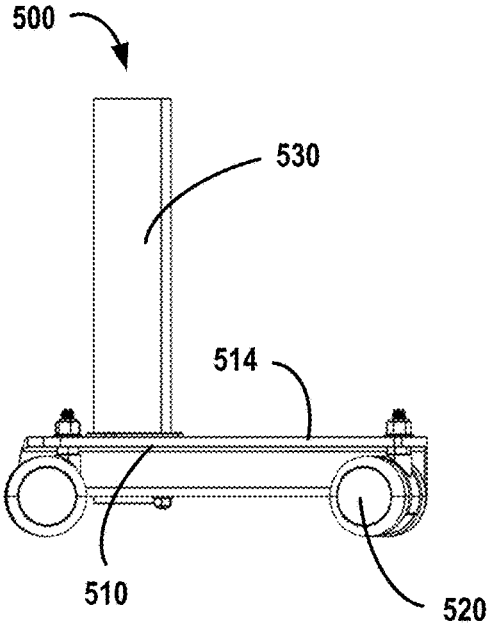
FIG. 12C illustrates a side view of the movable stand of FIG. 12A, in accordance with aspects of the disclosure.

As shown in the FIG. 11, the diverter 50 and/or the hollow articulating structure 100 may be releasably connected to an alternate movable stand 500. As shown in FIGS. 12A-12C, the movable stand 500 may include a base 510, a plurality of casters or wheels 520, and a mount 530. The movable stand 500 may be formed from a metallic sheet that is formed into a multi-level shape such that a central portion 512 of the base 510 is below a pair of upper flanges 514 that are connected with side walls 516. The base 510 may have a forward end 518 that is wider than the rearward end 519. Each side wall 516 may be angled such that the side wall 516 and the central portion 512 may form an obtuse angle within a range between 91 degrees and 150 degrees. The width of each upper flange 514 may have a constant width such that the central portion 512 has a smaller width at the rearward end 519 and a larger width at the forward end 518. The central portion 512 may be spaced below upper flanges 514. The lower center central portion 512 may help to lower the center of gravity of the combination of the articulating structure 100 and the movable stand 500 to help make the system easier to maneuver and to help prevent the movable stand 500 from tipping.

The mount 530 may be removably connected to the central portion 512. The central portion 512 may include a plurality of holes 513 to allow the mount 530 to be relocated at different locations on the central portion 512. The movable mount 530 may allow the movable stand 500 to be connected to a variety of portable vacuums or dust extractors. The mount 530 may comprise a hollow structure and may have the same diameter as the pipe 170 to releasably attach to a diverter 50, which in turn connects to the hollow articulating structure 100. The movable stand 500 may also include a braking mechanism to lock at least one or more casters 520 to prevent any unwanted movement of the movable stand 500. In some cases, the base 510 may be formed from a metallic material such as steel and in some cases may be formed from a forming a sheet of metallic material into the shape.

Figure 13:
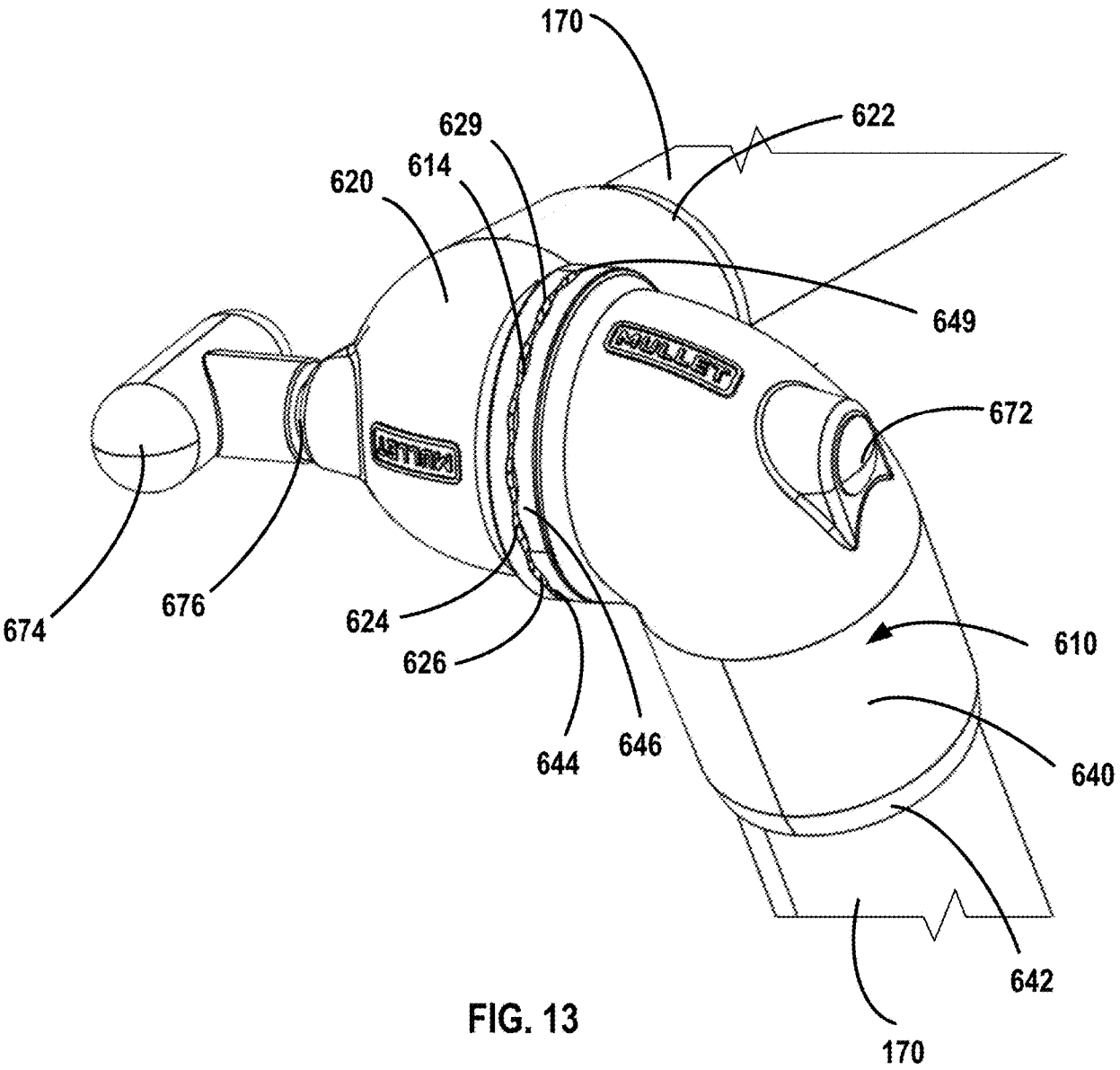
FIG. 13 illustrates a perspective view of an alternate knuckle assembly of the hollow articulating structure of FIG. 1, in accordance with aspects of the disclosure.
Figure 14:
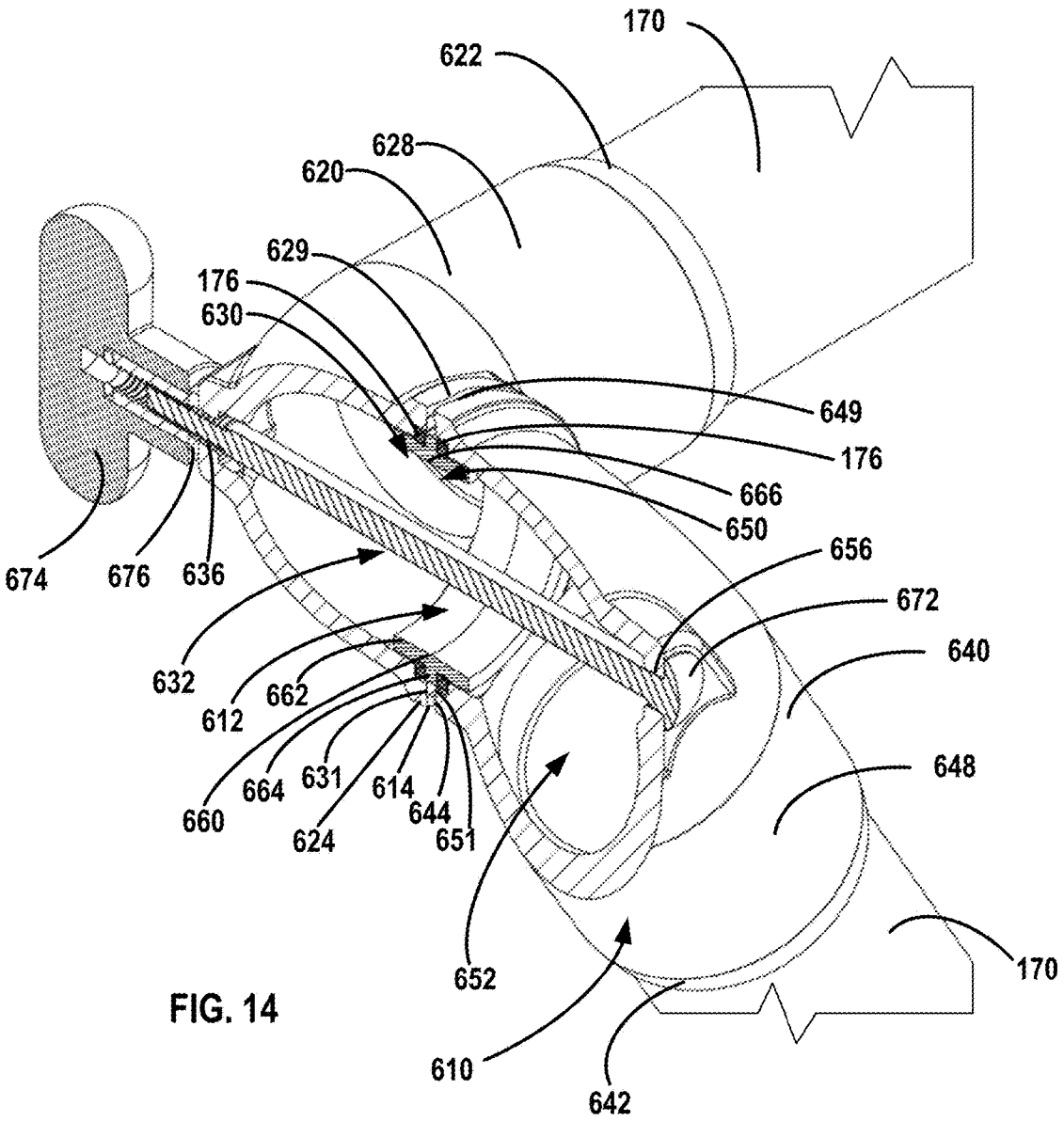
FIG. 14 illustrates a cross-sectional perspective view of the knuckle assembly of the hollow articulating structure of FIG. 13, in accordance with aspects of the disclosure.

FIGS. 13 and 14 illustrate an alternate knuckle assembly 610 that may be used the hollow articulating structure 100. For knuckle assembly 610, the features are referred to using similar reference numerals under the "6xx" series of reference numerals, rather than "1xx" as used in the knuckle assembly 110 illustrated in FIGS. 2-3. Accordingly, certain features of the knuckle assembly 610 that were already described above with respect to knuckle assembly 110 of FIGS. 2-3 may be described in lesser detail, or may not be described at all. The knuckle assembly 610 may be used interchangeably with the knuckle assembly 110 of articulating structure 100 described in the examples described above.

Each knuckle assembly 610 may include a first knuckle member 620, a second knuckle member 640, and a bushing 660 positioned between the two knuckle members 620, 640 that are connected together. The first knuckle member 620 and the second knuckle member 640 may be rotationally fixed or rotationally movable relative to each other. Each knuckle member 620, 640 can be rotated fully around its corresponding knuckle member, such that each knuckle member 620, 640 can rotate 360 degrees around each other. In addition, each knuckle member 620, 640 may be hollow where each knuckle member 620, 640 has a passageway 632, 652 respectively. When the knuckle members 620, 640 are connected together the two passageways 632, 652 join together to form a knuckle assembly passageway 612 that extends through the knuckle assembly 610 to allow a fluid (e.g. air or liquid) to move through the knuckle assembly 610 back to the vacuum source 10. Thus, the airflow passes through the first end 642 of the second knuckle member 640 through the knuckle assembly passageway 612 and exits the first end 622 of the first knuckle member 620.

Each knuckle member 620, 640 may be releasably connected to each pipe 170 via a friction fit. The openings at the first end 622, 642 of the respective knuckle members 620, 640 may be sized to match an outer diameter of the pipe 670. The openings at the first ends 622, 642 may have a slight taper to allow each pipe 170 to be received and retained within its respective opening. In some cases, the knuckle members 620, 640 may be formed from a material that allows the openings to elastically deform to retain the pipes 170.

As best shown in FIGS. 13 and 14, the first knuckle member 620 may comprise a first opening 625 at a first end 622, where the first opening 625 releasably receives a hollow pipe 170 using a friction fit, a second end 624 with a second opening 630, and a first knuckle member body 628 that extends between the first end 622 and the second end 624 creating a passageway 632 from the first opening 625 to the second opening 630. The first knuckle member 620 may further include a flange 626 that extends around the second opening 630, where the flange 626 includes a groove on an outward facing surface 631 of the flange 626. The outward facing surface 631 may extend from a perimeter edge of the flange 626 to an interior edge of the second opening 630. The groove may be formed at a corner of the flange 626 such that the groove is located at a corner of an outward facing surface and an inward facing surface (i.e. open towards second opening 630). The passageway 632 may be oriented in a different direction at the first opening 625 than at the second opening 630. For example, the direction of the passageway 632 at the first opening 625 may be substantially perpendicular to the direction of the passageway 632 at the second opening 630.

Similarly, the second knuckle member 640 may comprise a first opening 645 at a first end 642, where the first opening 645 releasably receives a hollow pipe 170 using a friction fit, a second end 644 with a second opening 650, and a second knuckle member body 648 that extends between the first end 642 and the second end 644 creating a passageway 652 from the first opening 645 to the second opening 654. The second knuckle member 640 may further include a flange 646 that extends around the second opening 650, where the flange 646 includes a groove on an outward facing surface 651 of the flange 646. The outward facing surface 651 may extend from a perimeter edge of the flange 646 to an interior edge of the second opening 650. The outward facing surface 631 of the flange 626 may face the outward facing surface 651 of the flange 646. The groove may be formed at a corner of the flange 646 such that the groove is located at a corner of an outward facing surface and an inward facing surface (i.e. open towards second opening 650). The passageway 652 may be oriented in a different direction at the first opening 645 than at the second opening 654. For example, the direction of the passageway 652 at the first opening 645 may be substantially perpendicular to the direction of the passageway 652 at the second opening 650.

The pair of knuckle members 620, 640 may be releasably joined together with a bushing 660 positioned between the two members 620, 640. In the illustrated examples, the bushing 660 may include a rib 664 that extends outward from the cylindrical bushing wall 662. The rib 664 may extend partially through a width of the flanges 626, 646 (i.e., where a width of the flanges 626, 646 is oriented a same direction as a diameter of the openings 625, 645). The rib 664 may be positioned between the first knuckle member 620 and the second knuckle member 640. The bushing 660 may include an opening 666 that has a diameter that is the same diameter as the inner diameter of the pipe 170 to not impede or reduce the airstream flow through passageway 612 of the knuckle assembly 610. In some examples, the cylindrical bushing wall 662 may the received in a pair of recesses located on an interior surface at or near the respective second ends 624, 644 of the knuckle members 620, 640. The pair of recesses may be cylindrical in shape and have an inward facing surface that faces an outward facing surface of the cylindrical bushing wall 662. The bushing 160 may be formed from a polymer material, such as polypropylene, acetal, or other similar material. The rib 664 may help to provide a bearing surface for the gaskets to compress against to help seal the juncture between the two knuckle members 620, 640.

As shown in FIG. 14, the knuckle assembly 610 may further include a mechanical fastener arrangement to secure the knuckle members 620, 640 together. A mechanical fastener 672 may extend through a side opening 656 of the second knuckle member 640 and also through a side opening 636 of the first knuckle member 620. A corresponding mechanical fastener 674 (i.e. a nut or corresponding fastener to mechanical fastener 672) may connect to the mechanical fastener 672 to apply or release pressure on the knuckle members 620, 640. For instance, when the mechanical fastener 674 is tightened, the knuckle members 620, 640 may be rotatably and laterally fixed such that the knuckle members 620, 640 are restrained from moving relative to each other. However, if the mechanical fastener 674 is loosened to release pressure between the knuckle members 620, 640, the knuckle members 620, 640 are rotatably (and possibly laterally) movable relative to each other. This rotatably movable connection allows a user to adjust the positions of each knuckle member 620, 640 independently. As the knuckle members 620, 640 move relative to each other, the pipes 170 that are connected at the first ends 622, 642 move with their corresponding knuckle members 620, 640. When the mechanical fastener 674 is in a tightened configuration such that pressure is applied to the gaskets 176 compressing the gaskets 176 between the rib 664 and the respective flanges 626, 646, the airflow may flow through the knuckle assembly 610. In some examples, a washer 676 may be located between the mechanical fastener 674 and the first knuckle member body 628. The washer 676 may be formed from a low friction material or have a low friction coating, such as polytetrafluoroethylene (PTFE). The washer may have a first washer surface that contacts an outer surface of the first knuckle member body adjacent the second side opening. The first washer surface has a first coefficient of friction, and the outer surface of the first knuckle member has a second coefficient of friction, wherein the first coefficient of friction is less than the second coefficient of friction. The washer 676 may prevent loosening of the fastener 672 during rotational movement of the knuckle members 620, 640. For instance, when the knuckle members 620, 640 are rotationally fixed to each other with the gasket pressure (e.g., the knuckle members are rotationally fixed but have a gap 614 between the flanges 626, 646), the low friction properties of the washer 676 may help to allow movement of one knuckle member relative to another knuckle member without further loosening of the fastener 672. In addition, the washer 676 may also help prevent any unintentional movement of the knuckle members 620, 640 with respect to each other when the fasteners 672, 674 are tightened. The washer 676 may also help to seal the side openings 636, 656 of the respective knuckle members 620, 640.

In some examples, each flange 626, 646 may have a plurality of wavy teeth 629, 649 that interlock with each other to provide a more secure joint when the two knuckle members 120, 140 are rotationally fixed, when the mechanical fasteners 172, 174 are tightened together. The plurality of wavy teeth 629, 649 may extend around a perimeter of each flange 626, 646 and may comprise a smooth undulating surface arranged on each flange 626, 646 with peaks and valleys such that the peak of one flange 626, 646 is located within a valley of the other flange 646, 626 to rotationally secure the knuckle members 620, 640 together.

As discussed above, an annular gasket 176 may be received in the grooves that are arranged in outward facing surfaces 631, 651 the respective flanges 626, 646. The gaskets 176 may be formed from an elastomeric material, such as ethylene propylene diene monomer (EPDM) rubber. The gaskets 176 may compress onto the rib 664 of the bushing 660 when the mechanical fasteners 672, 674 are tightened to create a seal to prevent any leakage of air through the knuckle assembly 610. In some examples, the mechanical fasteners 672, 674 may be tightened enough to prevent movement between the two knuckle members 620, 640 such that the knuckle members 620, 640 maintain a stationary rotational relationship until acted on by an outside force (i.e., the knuckle members 620, 640 are rotationally fixed), but a gap 614 or space may still be present between the flanges 626, 646. In these instances, the friction between the gaskets 176 and the rib 664 of the bushing 660 may prevent rotational movement between the two knuckle members 620, 640 until the knuckle members are acted upon by an outside force. In addition, the bushing wall 662 may have a portion that extends and overlaps through each of the second openings 630, 650 to reinforce the joint between the knuckle members 620, 640 and also create a cover over the joint to further prevent any air leakage.

Each knuckle member 620, 640 may be formed from a polymer material and may be formed using a molding technique such as injection molding, rotational molding, or other molding technique known to one skilled in the art. In some examples, the knuckle members 620, 640 may be formed from polycarbonate or a clear polymeric material to allow a user to see if any obstruction is present within the knuckle assembly 610. In some examples, the pipes 170 may also be formed from a clear polymer material. The knuckle members 620, 640 may be substantially identical such that the both knuckle members 620, 640 may be formed in the same molding tool.

The various embodiments described herein enable connection of an articulating boom arm. It is also understood that in other embodiments, the various devices, components, and features of the boom arm described herein may be constructed with similar structural and functional elements having different configurations, including different ornamental appearances. Still other benefits may be recognized by those skilled in the art. Accordingly, while the specific embodiments have been illustrated and described, numerous modifications come to mind without significantly departing from the spirit of the invention and the scope of protection is only limited by the scope of the accompanying claims.

What is claimed is:

1. A hollow articulating structure configured to connect to a vacuum source comprising: a first hollow pipe connected to the vacuum source; a second hollow pipe; and a knuckle assembly comprising: a first knuckle member that includes a first opening that receives an end of the first hollow pipe with a friction fit, a second opening, a first knuckle member body extending from the first opening to the second opening creating a first passageway from the first opening to the second opening; wherein the first passageway at the first opening is oriented in a different direction than the first passageway at the second opening; a second knuckle member that includes a third opening that receives a first end of the second hollow pipe, a fourth opening, a second knuckle member body extending from the third opening to the fourth opening creating a second passageway from the third opening to the fourth opening; wherein the second passageway at the third opening is oriented in a different direction than the second passageway at the fourth opening; and wherein the first knuckle member is selectively rotationally fixed to the second knuckle member or rotationally movable with the second knuckle member; wherein the knuckle assembly further comprises a bushing that includes a cylindrical bushing wall and a rib that extends outward from the bushing wall, wherein the rib is positioned between a portion of the first knuckle member and a portion of the second knuckle member.

2. The hollow articulating structure of claim 1, wherein when the first knuckle member and the second knuckle member are rotationally movable to each other, the first knuckle member and the second knuckle member are rotationally movable to each other through 360 degrees.

3. The hollow articulating structure of claim 1, wherein the knuckle assembly further comprises: a first gasket received in a first groove located on a first outward facing surface of a first flange extending around the second opening of the first knuckle member, wherein the first outward facing surface extends from a perimeter edge of the first flange to an interior edge of the second opening; and a second gasket received in a second groove located on a second outward facing surface of the second flange extending around the fourth opening of the second knuckle member, wherein the second outward facing surface extends from a perimeter edge of the second flange to an interior edge of the fourth opening; and wherein the rib of the bushing is located between the first gasket and the second gasket.

4. The hollow articulating structure of claim 3, wherein the first flange includes a plurality of wavy teeth, wherein the plurality of wavy teeth comprises an undulating surface of peaks and valleys.

5. The hollow articulating structure of claim 1, wherein the bushing wall has a portion that extends through the second opening of the first knuckle member and the fourth opening of the second knuckle member.

6. The hollow articulating structure of claim 1, wherein the knuckle assembly further comprises: a mechanical fastener that extends through a first side opening of the second knuckle member and also extending through a second side opening of the first knuckle member to connect the first knuckle member and the second knuckle member; wherein when a nut is tightened on the mechanical fastener, the first knuckle member is rotationally fixed to the second knuckle member; and wherein when the nut is loosened on the mechanical fastener, the first knuckle member is rotationally movable with the second knuckle member.

7. The hollow articulating structure of claim 6, wherein a washer is located between the nut and the second side opening, wherein the washer has a first washer surface that contacts an outer surface of the first knuckle member body adjacent the second side opening, wherein the first washer surface has a first coefficient of friction, and the outer surface of the first knuckle member has a second coefficient of friction, wherein the first coefficient of friction is less than the second coefficient of friction.

8. The hollow articulating structure of claim 1, wherein the first knuckle member is formed from a clear polymer material.

9. The hollow articulating structure of claim 1, further comprising: a second knuckle assembly, comprising: a third knuckle member that includes a fifth opening that receives a second end of the second hollow pipe with a friction fit, a sixth opening, a third knuckle member body extending from the fifth opening to the sixth opening creating a third passageway from the first opening to the second opening; a fourth knuckle member that includes a seventh opening of the fourth knuckle member that receives a first end of a third hollow pipe, a fourth knuckle member body extending from the seventh opening to an eighth opening creating a fourth passageway from the seventh opening to the eighth opening; wherein the third knuckle member is selectively rotationally fixed to the fourth knuckle member or rotationally movable with the fourth knuckle member; and a hood connected to a second end of the third hollow pipe, wherein the hood is configured to be positioned in a location to provide suction from the vacuum source to a desired location.

10. The hollow articulating structure of claim 9, further comprising: a diverter that is connected to the vacuum source and also connected to the first hollow pipe and connected to a mount of a movable stand, wherein the movable stand Non-Provisional comprises a second end of the diverter connected to the mount, wherein the mount includes a base with a central portion and a pair of upper flanges on opposite sides of the central portion, wherein the central portion is spaced below the pair of upper flanges and wherein the central portion has a smaller width at a rearward end and a larger width at a forward end, and wherein the movable stand further comprises a plurality of wheels.

11. The hollow articulating structure of claim 9, further comprising a diverter that is connected to the vacuum source and also connected to the first hollow pipe and connected to a stationary worksurface.

12. The hollow articulating structure of claim 1, wherein a dust collector is connected to the vacuum source and connected to the first hollow pipe.

13. A hollow articulating structure configured to connect to a vacuum source comprising: a first hollow pipe connected to the vacuum source; a second hollow pipe; and a knuckle assembly comprising: a first knuckle member that includes a first opening that receives an end of the first hollow pipe with a friction fit, a second opening, a first knuckle member body extending from the first opening to the second opening creating a first passageway from the first opening to the second opening, and a first flange extending around the second opening; wherein the first flange includes a first groove located on a first outward facing surface, wherein the first outward facing surface extends from a perimeter edge of the first flange to an interior edge of the second opening; a second knuckle member that includes a third opening that receives a first end of the second hollow pipe, a fourth opening, a second knuckle member body extending from the second opening to the fourth opening creating a second passageway from the third opening to the fourth opening, and a second flange extending around the fourth opening; wherein the second flange includes a second groove located on a second outward facing surface, wherein the second outward facing surface extends from a perimeter edge of the second flange to an interior edge of the fourth opening; wherein the first outward facing surface faces the second outward facing surface; and wherein the first knuckle member and the second knuckle member are selectively rotationally movable to each other, and wherein the first knuckle member and the second knuckle member is configured to be rotationally movable to each other through 360 degrees.

14. The hollow articulating structure of claim 13, wherein the knuckle assembly further comprises a bushing that includes a cylindrical bushing wall and a rib that extends outward from the bushing wall, wherein the rib is positioned between a portion of the first outward facing surface and a portion of the second outward facing surface.

15. The hollow articulating structure of claim 14, the knuckle assembly further comprises a first gasket received in the first groove of the first flange and positioned between the first flange and the rib of the bushing, and a second gasket received in the second groove of the second flange and positioned between the second flange and the rib of the bushing.

16. The hollow articulating structure of claim 13, further comprising: a second knuckle assembly, comprising: a third knuckle member that includes a fifth opening that receives a second end of the second hollow pipe with a friction fit, a sixth opening, a third knuckle member body extending from the fifth opening to the sixth opening creating a third passageway from the first opening to the second opening; a fourth knuckle member that includes a seventh opening that receives first end of a third hollow pipe, a fourth knuckle member body extending from the seventh opening to an eighth opening creating a fourth passageway from the seventh opening to the eighth opening; wherein the third knuckle member is capable of being rotationally movable with the fourth knuckle member; and a hood connected to a second end of the third hollow pipe; and wherein the hood is configured to be positioned in a location to provide suction from the vacuum source to a desired location.

17. A knuckle assembly for a hollow articulating structure comprising: a first knuckle member that includes a first opening configured to receive an end of a first hollow pipe, a second opening, a first knuckle member body extending from the first opening to the second opening creating a first passageway from the first opening to the second opening, and a first flange extending around the second opening; wherein the first flange includes a first groove on a first outward facing surface and wherein the first passageway at the first opening is oriented in a different direction than the first passageway at the second opening, wherein the first outward facing surface extends from a perimeter edge of the first flange to an interior edge of the second opening; and a second knuckle member that includes a third opening that is configured to receive an end of a second hollow pipe, a fourth opening, a second knuckle member body extending from the third opening to the fourth opening creating a second passageway from the third opening to the fourth opening, and a second flange extending around the fourth opening; wherein the second flange includes a second groove on a second outward facing surface, and wherein the second passageway at the third opening is oriented in a different direction than the second passageway at the fourth opening, wherein the second outward facing surface extends from a perimeter edge of the second flange to an interior edge of the fourth opening; and a bushing that includes a cylindrical bushing wall and a rib that extends outward from the bushing wall, wherein the rib is positioned between a portion of the first knuckle member and a portion of the second knuckle member; and wherein the first knuckle member is selectively rotationally fixed to the second knuckle member or rotationally movable with the second knuckle member, and when the first knuckle member and the second knuckle member are rotationally movable to each other, the first knuckle member and the second knuckle member are rotationally movable to each other through 360 degrees.

18. The knuckle assembly of claim 17, the knuckle assembly further comprising: a first gasket received in the first groove of the first outward facing surface and a second gasket received in the second groove of the second flange, wherein the rib is positioned between the first gasket and the second gasket.

19. The knuckle assembly of claim 18, wherein the first flange includes a plurality of wavy teeth, wherein the plurality of wavy teeth comprises an undulating surface of peaks and valleys.

* * * * *